US007077768B2

(12) United States Patent
Filippini

(10) Patent No.: US 7,077,768 B2
(45) Date of Patent: Jul. 18, 2006

(54) COMPOSITE RACQUET WITH DOUBLE TUBE HEAD FRAME

(75) Inventor: Rafael G. Filippini, Chula Vista, CA (US)

(73) Assignee: EF Composite Technologies, L.P., San Diego, CA (US)

( * ) Notice: Subject to any disclaimer, the term of this patent is extended or adjusted under 35 U.S.C. 154(b) by 138 days.

(21) Appl. No.: 10/854,938

(22) Filed: May 27, 2004

(65) Prior Publication Data

US 2005/0266940 A1 Dec. 1, 2005

(51) Int. Cl.
*A63B 49/02* (2006.01)

(52) U.S. Cl. ..... 473/535

(58) Field of Classification Search ..... 473/535–537, 473/524, 540, 547
See application file for complete search history.

(56) References Cited

U.S. PATENT DOCUMENTS

| | | | |
|---|---|---|---|
| 1,532,991 | A | 4/1925 | De Meza |
| 1,611,232 | A | 12/1926 | Reach |
| 1,618,727 | A | 2/1927 | Reach |
| 1,750,644 | A | 3/1930 | Norton |
| 2,236,414 | A | 3/1941 | Reach |
| 2,395,864 | A | 3/1946 | Geerlings et al. |
| 2,626,804 | A | 1/1953 | Robinson |
| 2,853,400 | A | 9/1958 | Ahlbin |
| 3,500,572 | A | 3/1970 | Johnson |
| 3,540,728 | A | 11/1970 | Palmer |
| 3,547,440 | A | 12/1970 | Deer |
| 3,582,073 | A | 6/1971 | Melnick et al. |
| 3,625,512 | A | 12/1971 | Latham et al. |
| 3,752,478 | A | 8/1973 | Flak |
| 3,815,660 | A | 6/1974 | Gallagher et al. |
| 3,899,172 | A | 8/1975 | Vaughn et al. |
| 4,061,520 | A | 12/1977 | Cecka et al. |
| 4,066,260 | A | 1/1978 | Rodgers, Jr. |
| 4,166,616 | A | 9/1979 | Kohzu |
| 4,176,841 | A | 12/1979 | Sommer |
| 4,185,822 | A | 1/1980 | Li |
| 4,203,596 | A | 5/1980 | Nagamoto |
| 4,264,389 | A | 4/1981 | Staub et al. |
| 4,278,251 | A | 7/1981 | Lafourcade |
| 4,280,699 | A | 7/1981 | Drake |
| 4,282,642 | A | 8/1981 | Rodgers, Jr. |
| 4,290,604 | A | 9/1981 | Held |
| 4,331,331 | A | 5/1982 | Rodgers, Jr. |
| 4,340,226 | A | 7/1982 | Haines |
| 4,353,551 | A | 10/1982 | Arieh et al. |
| 4,357,013 | A | 11/1982 | Fernandez et al. |
| 4,365,806 | A | 12/1982 | Reid et al. |
| 4,436,305 | A | 3/1984 | Fernandez |
| 4,614,341 | A | 9/1986 | Fernandez |
| 4,614,626 | A | 9/1986 | Frerking |
| 4,772,021 | A | 9/1988 | Maynard |
| 4,834,383 | A | 5/1989 | Woehrle et al. |

(Continued)

*Primary Examiner*—Raleigh W. Chiu
(74) *Attorney, Agent, or Firm*—Daspin & Aument, LLP; Jefferson Perkins

(57) ABSTRACT

A sports racquet frame is built of a composite of laminations of fibrous material as impregnated by a thermosetting resin. The head section of the frame has an upper tube preferably disposed above the string bed plane and a lower tube preferably disposed below the string bed plane. A solid bridge of material integrally joins the upper tube to the lower tube. In a preferred embodiment the bridge is disposed radially exteriorly of the center line of the tubes, to maximize the length of string segments, which are strung to the bridge.

15 Claims, 9 Drawing Sheets

U.S. PATENT DOCUMENTS 4,913,434 A 4/1990 Fischer
4,930,778 A * 6/1990 Mizuno ..... 473/540
4,935,185 A 6/1990 Mott
4,948,131 A 8/1990 Nakanishi
4,981,639 A 1/1991 Mott
4,983,242 A 1/1991 Reed
5,014,987 A 5/1991 Soong
5,039,096 A 8/1991 Chen
5,100,136 A 3/1992 Chen
5,143,669 A 9/1992 Mott
5,172,911 A 12/1992 Chang
5,174,568 A 12/1992 You
5,184,818 A 2/1993 Lo
5,217,223 A 6/1993 Feeney
5,219,166 A 6/1993 Chang
5,242,162 A 9/1993 Hong
5,242,724 A 9/1993 You
5,277,422 A * 1/1994 Coe ..... 473/537
5,314,180 A 5/1994 Yamagishi et al.
5,358,261 A 10/1994 Cheng
5,368,298 A 11/1994 You
5,409,215 A 4/1995 You
5,460,370 A 10/1995 Tung-Han
5,516,100 A 5/1996 Natsume
5,524,884 A 6/1996 Haines
5,642,881 A 7/1997 Stennett
5,860,878 A 1/1999 You
5,921,873 A * 7/1999 Brown ..... 473/540
6,012,996 A 1/2000 Lo
6,071,203 A 6/2000 Janes et al.
6,416,432 B1 * 7/2002 Rosen et al. ..... 473/524
6,565,463 B1 5/2003 Pai
6,589,125 B1 * 7/2003 Tsai ..... 473/539
6,638,187 B1 10/2003 Tsai
2005/0266940 A1 * 12/2005 Filippini ..... 473/535

* cited by examiner

COMPOSITE RACQUET WITH DOUBLE TUBE HEAD FRAME

BACKGROUND OF THE INVENTION

Sports racquets, which term includes tennis rackets, squash racquets, badminton racquets and racquetball racquets, are all strung with strings across a head portion of a frame, which head portion surrounds and defines a string bed. The string bed is designed to intercept and return a game piece such as a shuttlecock, racquetball or tennis ball.

Up into the 1960's sports racquets were made of wood. These racquets were replaced with racquets made of metal, typically of aluminum alloy, although steel has also been used. In the 1970's thermoplastic injection molded racquets were attempted, as reinforced with fiber whiskers. Also in the 1970's sports racquets began to be made from a composite material which has as its basic constituents (a) plural laminations of fibrous material such as carbon fiber, boron, fiberglass and/or aramid compositions, and (b) a binding thermosetting resin. While each succession of materials in general improved strength to weight ratios, the engineering problems associated with them differ markedly.

Racquets made from aluminum and related nonferrous alloys are made from extruded tubes, I-beams and like shapes, with or without internal reinforcing walls. The cross-sectional shape of the frame member is dictated by the extrusion die. The extrusion process permits tight control of the positioning of internal bridges, struts and reinforcements. Straight sections of aluminum extrusion may be stamped with drill positioning dimples, and with dimples or grooves to create space for strings, bumpers and handle parts. The straight extrusion may have sections of it crimped to vary the cross-section shape. The straight extrusion is then formed into a racquet frame by bending.

While forming racquet frames from extruded aluminum alloys is relatively cheap because of lower labor costs, the material has many limitations. An extruded metal cross-section cannot be altered with processes such as welding, crimping or pressing without weakening the strength of the original extruded structure. It is therefore common to have little or no variation in cross sectional shape along the length of the frame. Aluminum extrusions have substantial weight limitations. There may be areas along the frame which require additional strength or flexibility to limit breakage or improve playability. To effect changes to these areas while not weakening the frame, typically the cross-sectional shape along the entire length of the extrusion is changed. Those regions which did not require reinforcement are nonetheless made heavier.

Conventional composite frames are formed in molds. In the most common manufacturing process, a "layup" is created by applying multiple sheets or laminations, commonly formed of fibrous material such as carbon fiber, to a single bladder. The bladder in turn contains a rigid mandrel to control the desired layup shape. The sheets are pre-impregnated with a thermosetting resin prior to their application to the layup. This layup is placed in a mold and the mold is closed. The bladder is inflated with a single air nozzle to force the walls of the layup to the interior walls of the mold and the mold is then subjected to a thermal step. An artifact of this process is that composite racquet frames are commonly of a single-tube design. While there have been multiple-tube composite structures, it has been found that any internal divisions, bridges or lumens placed in these tubes are difficult to control in their placement because of variations in bladder air pressure, and attempts to include them in the past have been found to cause significant quality control and production problems.

SUMMARY OF THE INVENTION

According to one aspect of the present invention, there is provided a sports racquet with a frame that has a head portion across which strings are strung. The head portion includes an elongate upper tube which is disposed above the string bed plane and an elongate lower tube which is disposed below the string bed plane. A solid bridge of material, without any cavity in the direction of frame elongation (meaning a direction along the curved frame that is tangential to the string bed center), connects the upper tube with the lower tube and intersects the string bed plane. When a cross section is taken of the head portion, a center line can be drawn through the centers of the tubes, and the bridge is disposed to be outward of this center line so as to be relatively remote from the string bed center. This maximizes the free-space length of strings strung to the bridge.

According to another aspect of the invention, a sports racquet is provided which has a frame that is built of a composite of multiple laminations of fibrous material and a polymer, such as a thermosetting resin. A head portion of the racquet frame includes an upper tube, disposed above a plane in which the string bed resides, and a lower tube disposed alongside the upper tube but below the string bed plane. An elongate, solid bridge, without any cavity or void in the direction of frame elongation, is integrally formed with the upper and lower tubes, and joins and spaces apart the tubes. The bridge is the only structure of the frame which intersects the string bed plane. The structure has been found to exhibit superior strength and stiffness characteristics relative to both traditional single-tube composite racquets and aluminum alloy racquets of various extruded shapes.

In a third aspect of the invention, the racquet frame is made of an endless wall that in turn is made up of a plurality of laminations of fibrous material. Viewed in section, the endless wall has an outer portion that is relatively remote from the string bed center and an inner portion that is relatively proximate to the string bed center. The endless wall is used to form the upper tube, the lower tube and a single bridge between the upper and lower tubes. Along the depth of the bridge (defined as a dimension orthogonal to the string bed plane), the outer portion and inner portion of the endless wall are joined together such that there are no cavities or voids in the direction of frame elongation. Preferably, at least one lamination making a part of the endless wall is applied to the layup such that its fibers are aligned at an angle other than zero degrees (parallel to the tube axes) or ninety degrees (perpendicular to the tube axes). Since this lamination is present in both the outer portion of the endless wall and an inner portion of the endless wall, the orientation of the fibers in the lamination in the outer portion is at an angle to the orientation of the fibers in the lamination in the inner portion. This crossing of fiber direction strengthens the racquet frame.

In one embodiment, there is additionally provided one or more fins or walls which extend inwardly from the bridge toward the string bed center, which are joined to the tubes, and which are respectively disposed in planes that are at an angle to the string bed. These fins or walls are spaced apart from each other. Preferably, the fins or walls are integral with the frame structure, and are positioned at locations different than locations of string holes which are drilled into the bridge.

In another embodiment, which optionally may be combined any of the above embodiments, the head portion of the racquet frame has at least one elongate double-tube section that is joined end-to-end with at least one elongate single-tube section. The lengths of the single- and double-tube sections are chosen to best fit the strength and stiffness requirements of the design. In a preferred embodiment, two double-tube to single-tube transitions are effected in the throat area of the racquet.

The two-tube frame of the present invention exhibits greater strength and stiffness than a single-tube frame made with the same amount of material. Alternatively, the two-tube frame of the present invention permits a frame of similar strength and stiffness but using less material than a single-tube design of comparable strength and stiffness. The present invention exhibits far superior strength, stiffness and weight properties relative to known aluminum structures.

The use of a connecting bridge provides a structure through which single string holes can be formed instead of hole pairs through the tubes themselves (in each pair, one in the inner wall and one in the opposed, outer wall). The strength of the tubes themselves does not have to be compromised with holes. In the preferred embodiment, in which the bridge is disposed entirely outwardly of the tube center line, the length of strung string throughout the entire strung area of the racquet is maximized, optimizing the projectile-returning power of the racquet. The present invention provides a continuous channel through which each string segment passes to its connection to the bridge. Therefore, each string, even if it is strung to a point at the racquet corners, is strung in free space to a structure very close to the lateral exterior of the racquet frame, without any interference from support structures disposed interiorly of the bridge. This increases effective strung area of the racquet.

The use of composites (as herein defined to mean resin-impregnated fibrous laminations) permits substantial variation of cross section along the frame's length.

BRIEF DESCRIPTION OF DRAWINGS

Further aspects of the invention and their advantages may be discerned in the following detailed description, in which like characters denote like parts and in which.

DETAILED DESCRIPTION

Figure 1:
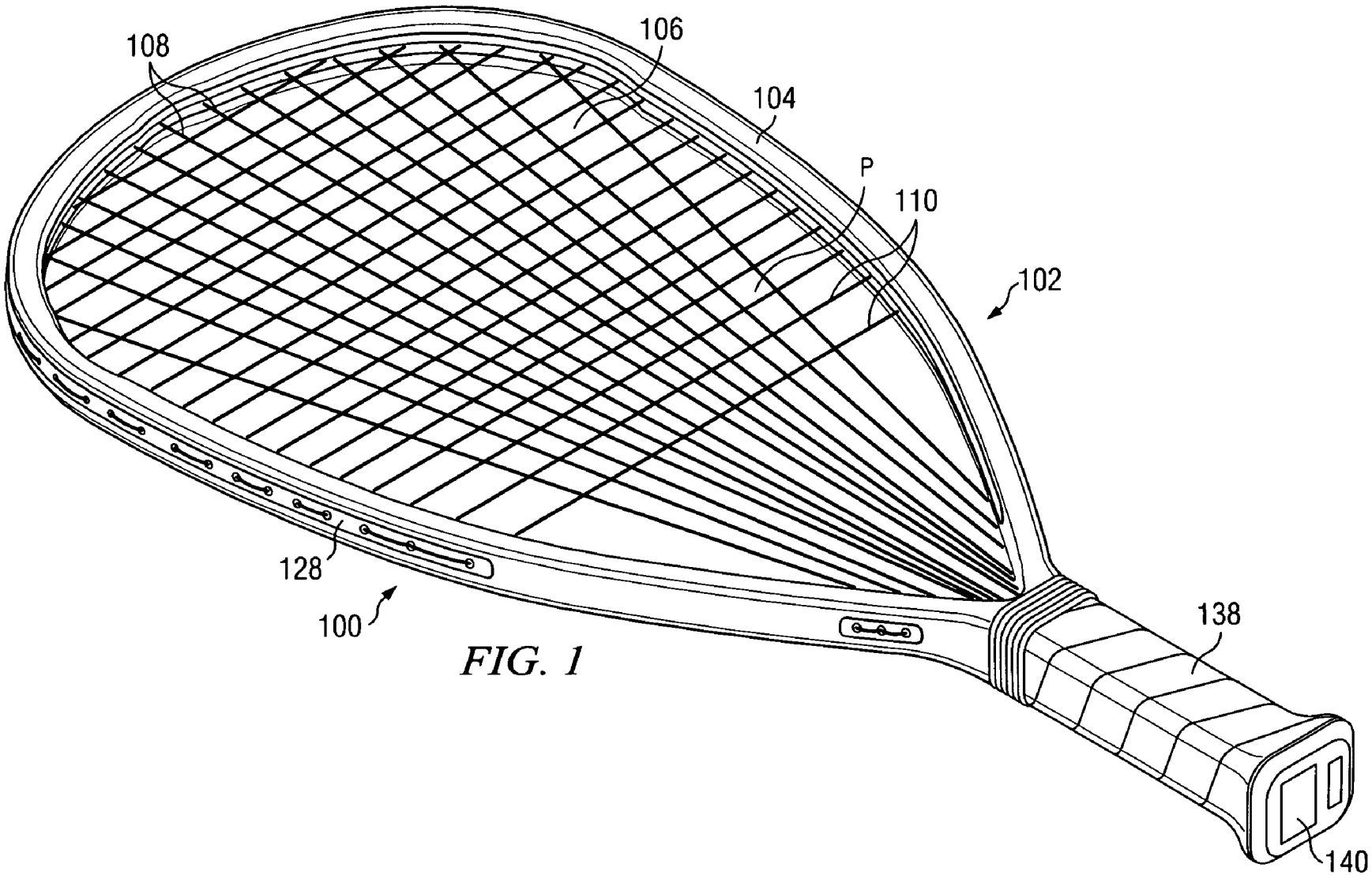
FIG. 1 is an isometric view of a first embodiment of a sports racquet according to the invention.
Figure 2:
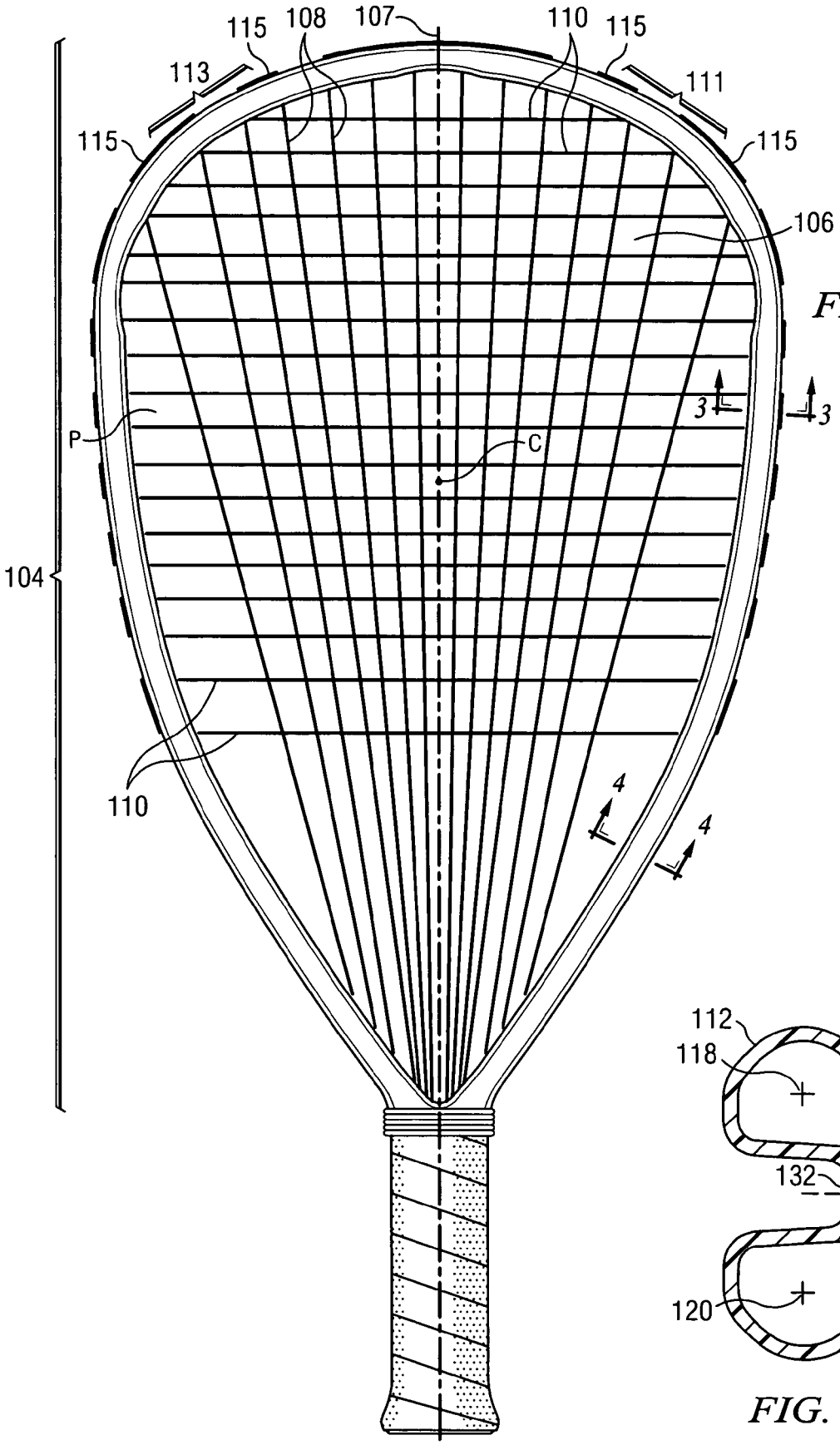
FIG. 2 is a plan view of the racquet shown in FIG. 1.

Referring first to FIGS. 1 and 2, a racquet indicated generally at 100 has a frame 102 including a head portion 104. The head portion 104 defines and surrounds a string bed 106, which substantially resides in a string bed plane P. In the illustrated embodiment, the string bed 106 and head portion 104 are bilaterally symmetrical around a vertical axis 107 which includes a center C. The string bed 106 is composed of a plurality of long or main strings 108 that are disposed somewhat in alignment with vertical axis 107 (in the illustrated embodiment, they fan out) and a plurality of cross strings 110 which are disposed at right angles to vertical axis 107. Preferably strings 108 and 110 are segments of one or two strings which are strung across the head portion 104 in a predetermined pattern. Where two strings are used to make up the string segments, different materials can be used to make up different ones of the string segments. For example, the main or long strings 108 may be selected to be made of Kevlar (a federally registered trademark of DuPont for its aramid fiber), while the cross strings may be selected to be made of nylon. Polyurethane is another material which sees employment as a racquet string.

In the illustrated embodiment, the head frame portion 104 has pronounced corners 111 and 113. These corners each possess at least one string hole 115 to which both a long string 108 and a cross string 110 are strung. The present invention permits this economy of string holes while at the same time maximizing the unconstrained length of the strings connected to them, as will be explained further herein.

While the racquet 100 pictured in FIGS. 1 and 2 is a racquetball racquet, the present invention has application to any sports racquet, including racquetball racquets, tennis rackets, badminton racquets and squash racquets.

Figure 4:
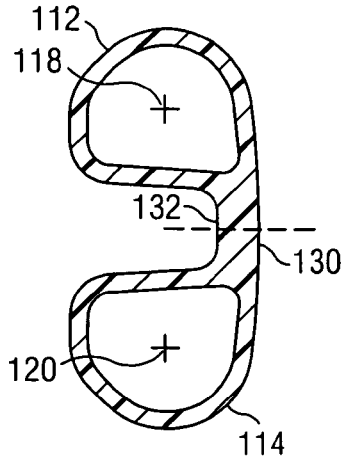
FIG. 4 is another sectional view taken substantially along line 4—4 of FIG. 2.
Figure 3:
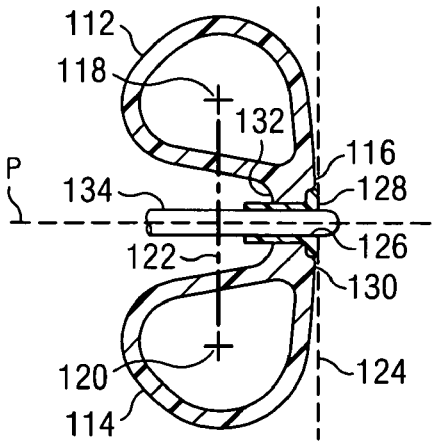
FIG. 3 is a sectional view taken substantially along line 3—3 of FIG. 2.

Referring to FIGS. 3 and 4, according to the embodiment illustrated therein, the frame head portion 104 is composed of an upper tube 112, a lower tube 114, and a bridge 116 which integrally joins together tubes 112 and 114, while at the same time spacing these tubes apart in a depth direction (defined herein to be normal to string bed plane P). FIG. 3 is a section taken along a string hole, while FIG. 4 is a section taken on a portion of the frame not having a string hole. The bridge 116 has no elongate hole or cavity in the direction of the frame head member's length or direction of elongation, and preferably has no holes or cavities at all except holes drilled for strings. Bridge 116, in the illustrated embodiment, is substantially perpendicular to string bed plane P.

Note that in the illustrated embodiment, tubes 112 and 114 are other than circular in cross section. Tubes 112 and 114 can take any of many cross sectional shapes according to the structural requirements of the racquet frame, and indeed these shapes can be varied along the length of the frame, as can be seen by comparing FIG. 3 with FIG. 4. Tubes 112 and 114 and bridge 116 are elongate in the direction of elongation of the head portion 104; in a preferred embodiment, tubes 112 and 114 and bridge 116 persist throughout a large majority of the periphery of the head portion 104.

Upper tube 112 has a center 118, while lower tube 114 has a center 120. A center line 122 can be drawn to connect these two loci. In a preferred embodiment, center line 122 is substantially normal to the string bed plane P. In FIGS. 3 and 4, the center C (see FIG. 2) of the racquet frame and string bed is toward the left. Importantly, in this embodiment the bridge 116 is positioned such that it is entirely and substantially displaced away from the center line 122, towards the extreme lateral periphery 124 (shown by a dotted line) of the racquet head portion 104. Except for the existence of a groove 126 furnished to seat a string grommet 128, a lateral outer surface 130 of the bridge 116 would be coincident with the outer periphery 124 of the racquet head portion 104.

This in turn means that an inner surface 132 of bridge 116 is positioned laterally outwardly as far as it can be. That in turn means that a string, such as string segment 134 in FIG. 3, strung to the bridge 116 at both its ends (to opposite sides of the racquet), is as long as it can possibly be, optimizing the energy that it can store and the length of unconstrained free space through which it can deflect without encountering frame structure. That stored energy means a more powerful projectile return.

In the illustrated embodiment, the bridge 116 is used as the string-supporting structure rather than either of the tubes 112 or 114. In older, simple-oval designs, for each string, a pair of holes had to be drilled, one in the outer wall and one in the inner wall. This hole-pairing raised issues of hole alignments, created additional wear on drills, and, with respect to the drilled inner wall hole, produced interference with the movement of the string, in many instances effectively reducing the unconstrained strung string length to end on the inner wall. In contrast, only one hole per string need be drilled in bridge 116.

The present invention also offers a solution to the problem of how to maximize effective strung length to anchoring points 115 at or near the corners 111, 113 of head frame 104 (see FIG. 2). In prior designs, string holes drilled all the way through the inner and outer tube walls at these points were drilled at angles substantially normal to the frame at those points. This, however, created a string path that likewise was substantially normal to the frame at the corners—but which was at a substantial angle to a horizontal cross string path, and which was at a substantial angle to the essentially vertical long or main string path. Even in designs where large holes or slots were opened up into the interior frame walls to permit the passage of the strings to the outer frame walls, there was a heightened incidence or probability of interference of the inner wall with the strings, undesirably shortening effective string length. Since the present invention creates a continuous channel through which strings may pass at any of a number of angles to the frame, including angles that substantially depart from the normal relative to the frame, the problem of inner wall interference with transverse string travel is eliminated. It is even possible, for the first time in a composite structure, to have a single string hole serve as an anchor for both a long string and a cross string, have the outer wall define the effective strung length of such strings, and at the same time have a fairly wide (and therefore stiff) supporting frame that nonetheless does not interfere with string transverse motion.

In a preferred embodiment, upper tube 112, lower tube 114 and bridge 116 retain their basic spatial relationship with each other around a large majority of the periphery of the frame head portion 104, creating a channel of additional free space and an effective extension of active string bed area. Further, it is preferred that at least a central zone of long strings 108 (FIGS. 1 and 2) proceed down a hollow throat 136 of the racquet handle or stem 138 (itself hollow; see FIG. 1) and terminate on or near a butt end 140 of the racquet. This means that most of the string segments in racquet 100 are as long as they possibly can be given the particular exterior dimensions of the racquet, optimizing the power of those string segments and the overall power of the racquet in general.

Figure 3B:
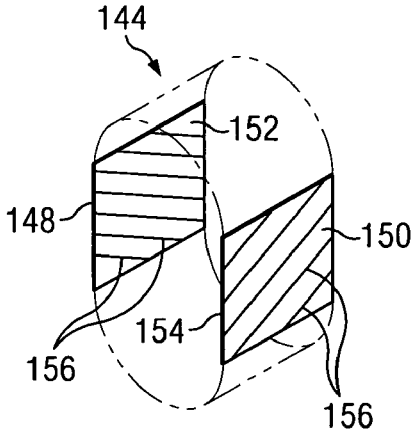
FIG. 3B is a schematic diagram showing fiber orientations of laminates used in one embodiment of the invention.
Figure 3A:
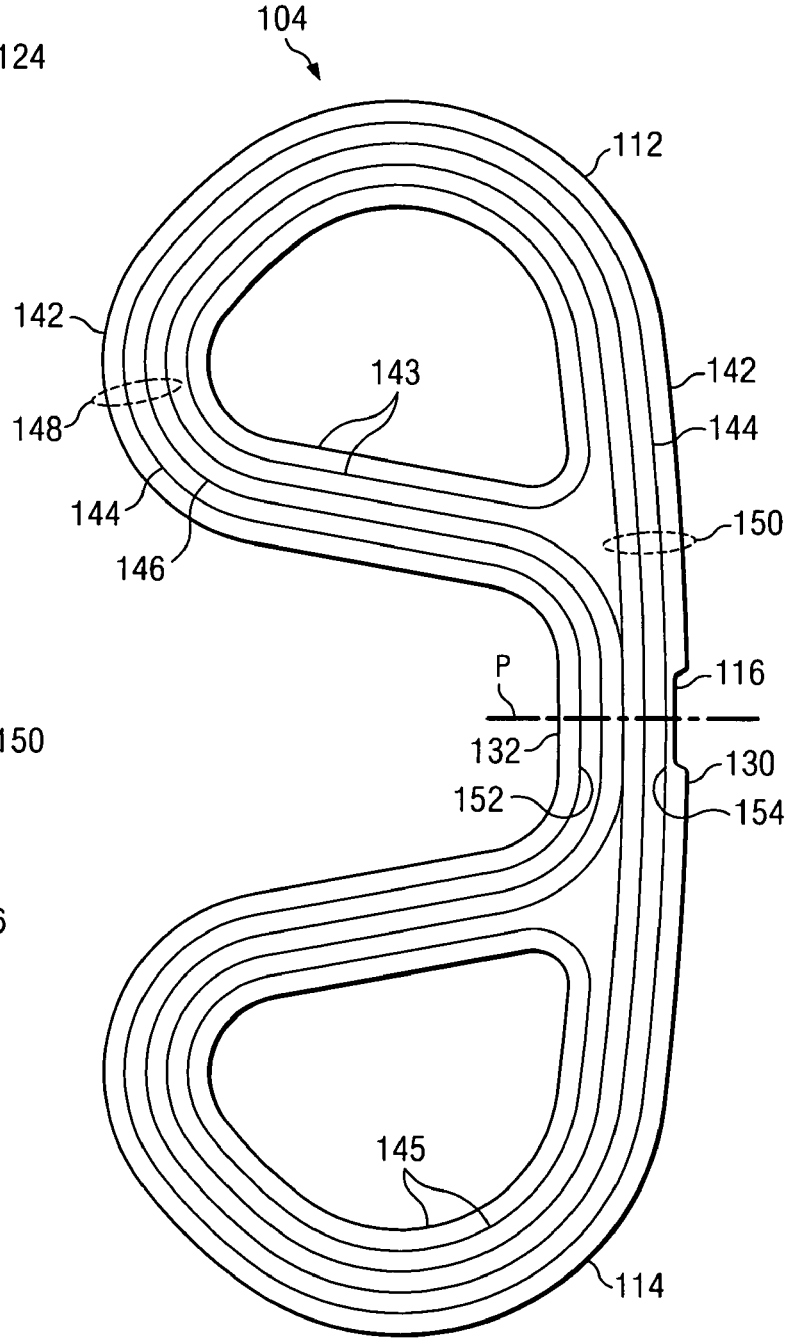
FIG. 3A is a sectional view taken substantially along line 3A—3A of FIG. 2, and enlarged to show internal detail.

FIG. 3A is a sectional view of FIG. 2 which has been enlarged so as to show internal detail. In this illustrated embodiment, upper tube 112, lower tube 114 and bridge 116 are made of a single, endless wall 142 that is made up of multiple, preimpregnated laminations 144, 146 (only a representative two are shown) of fibrous material. In a preferred embodiment, tubes 112 and 114 have additional laminations 143, 145 internal to endless wall 142, as explained under "Manufacture" below; during manufacture the laminations making up endless wall 142 are applied so as to encapsulate the individual tube laminations. There can be on the order of thirty such plies or laminations. The wall 142 has an inner portion 148 which is closer to string bed center C (see FIG. 2) and an outer portion 150 which is farther away from center C. Since wall 142 is endless, inner portion 148 and outer portion 150 are in actuality different portions of the same wall.

There are numerous fibrous materials which can be selected for inclusion in the racquet frame, including carbon fiber and, in areas for which particularly high impact resistance is desired, an aramid fabric such as DuPont's Kevlar. Fibrous materials are available in unidirectional and bidrectional sheets, including woven fabrics. Carbon fiber sheets include standard modulus, intermediate modulus, high modulus and high strength varieties. The fibrous laminations can also be selected from materials including boron and fiberglass.

There are many resin systems usable with the invention, including but not limited to epoxy resins and polyester resins. While thermosetting resins are preferred, thermoplastic polymers can also be used.

It is preferred that at least some of the plies or laminations 144, 146 be applied to the "layup" for the frame such that their fibers are neither parallel to a direction of elongation of the frame head portion 104, nor perpendicular thereto. Instead, they are oriented at a diagonal to these directions. In FIGS. 3A and 3B, lamination 144 is shown to have this orientation. This orientation will produce a portion 152 on inner portion or side 148, and a portion 154 on the outer portion or side 150. The dashed lines are representative of the fact that the same sheet or layer of material makes up both portions 152 and 154. Note that the fibers 156 are oriented in one diagonal direction within portion 152, and are oriented in a different diagonal direction within portion 154. Various diagonal orientations can be used, either alone or in combination, including 10, 22, 45 and 60 degrees.

Throughout the depth (considered as the direction perpendicular to plane P) of bridge 116, inner side 148 and outer side 150 are effectively fused together. This has a pair of beneficial effects. First, assuming that the number of plies or laminations is held the same, the thickness of bridge 116 is about double that of the wall making up upper tube 112 and lower tube 114. Second, since portions 152, 154 lie close to each other in parallel planes, there is a reinforcing effect because the orientations of the fibers 156 in inner portion 152 cross the orientations of the fibers 156 in the outer portion 154. This produces a stronger structure than where the fibers are all in alignment, much as plywood is stronger than a similar structure of unlaminated lumber.

In a preferred embodiment, the bridge 116 extends through the plane P, and is long enough that the strings connecting to it will not impinge on the exterior surfaces of walls 112 or 114 when they are deflected by an incident projectile.

Figure 5:
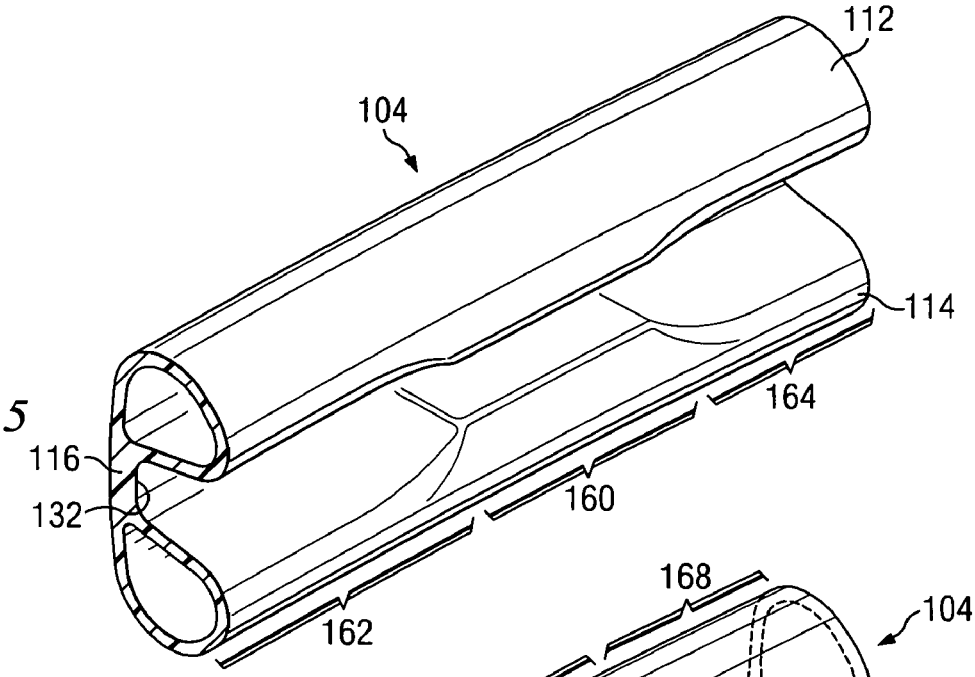
FIG. 5 is an isometric view of a portion of a racquet frame according to a second embodiment of the invention, showing how the spacing of the tubes apart from each other can be varied along the tubes' length.
Figure 6:
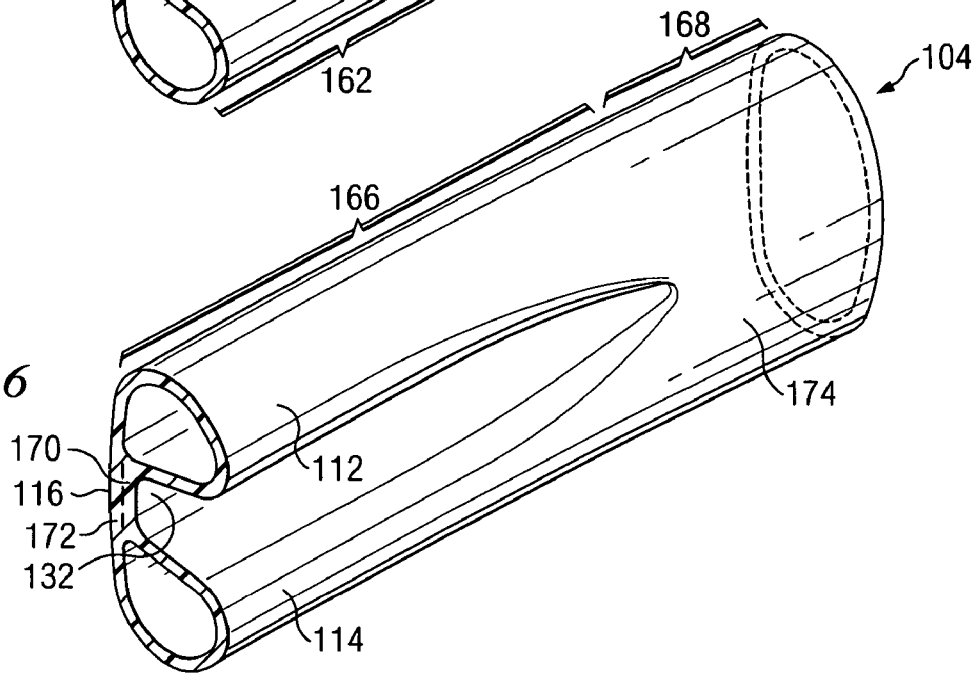
FIG. 6 is an isometric view of a section of racquet frame, showing a transition between single-tube and double-tube subportions.
Figure 7:
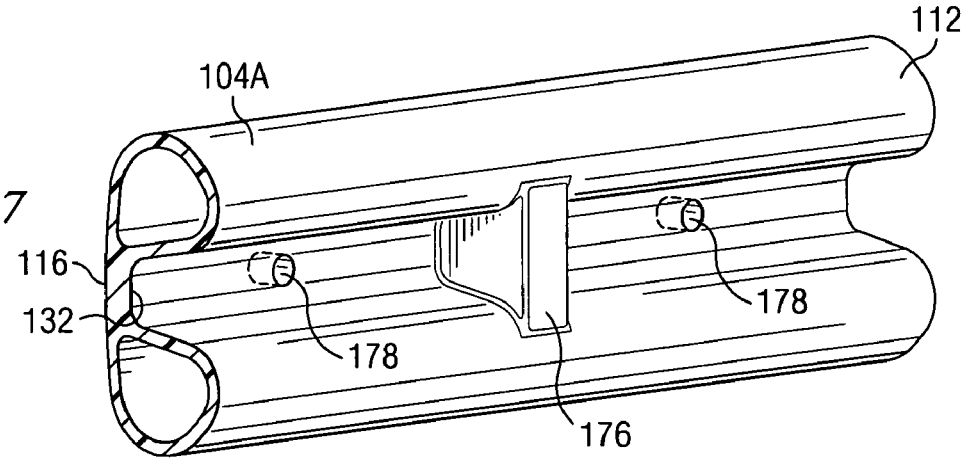
FIG. 7 is an isometric detail of a portion of a racquet frame according to a third embodiment of the invention, which includes multiple fins or walls extending inwardly from a bridge of the frame.

FIGS. 5–7 are illustrative of an advantage of the invention: the shape of the frame head portion 104 can be varied in numerous ways along its length, since its cross-sectional shape has not been dictated by an extrusion die. Varying cross-sectional frame shapes help control bending and torsion stiffness, impact resistance, resonant frequency, other playability characteristics and aesthetics. In the embodiment shown in FIG. 5, the spacing-apart of upper tube 112 from lower tube 114 has been changed along the frame's length. In a portion 160, the bridge 116 has been made shorter, such that the tubes 112 and 114 are positioned more closely together. In flanking portions 162 and 164, however, the tubes 112 and 114 are spaced further apart from each other (while still running generally in parallel with each other) by making bridge 116 longer.

In FIG. 6, a transition is shown from a double-tube subportion 166 to a single-tube subportion 168, as happens in the preferred embodiment as the frame head portion 104 gets close to the racquet throat 136 (FIG. 1). This preferably is effected by delaminating an inner wall portion 170 of the double-thickness bridge 116 from an outer wall portion 172, so that, as sections are taken more and more to the right in FIG. 6, the cavities defined by tubes 112 and 114 eventually become joined to each other. The interior surface 132 of bridge 116 trends laterally inwardly until it makes up a portion of a convex general interior surface 174.

FIG. 7 illustrates another structure made possible by using the methodology of the invention. A fin or wall 176 is integrally formed and molded as an extension of bridge 116, upper tube 112 and lower tube 114. This reinforcing structure 176 extends radially inwardly from general interior surface 132 generally toward center C (FIG. 2), but at one or more locations which will not interfere with the strings. It is preferred that fin or wall 176 be substantially orthogonal to string bed plane P and to the direction of elongation of frame head portion 104. Fin or wall 176 can be positioned midway between adjacent string holes 178. The number of fins or walls 176 in the racquet frame structure can be chosen as strength requirements of the design dictate. Using material in a fin or wall 176 presents an alternative to the designer, who otherwise would use the same weight of material in simply making the frame wall 142 thicker, either generally or locally.

The present invention also increases the amount of unimpeded string surface area as compared with prior art racquets of similar sizes and shapes. In Table I below, the embodiment of the invention illustrated in FIGS. 1 and 2 is compared with similar prior art "tear drop" racquets of very similar size and shape. "Bedlam", "Bedlam Stun" and "Bedlam 195" are brands of racquetball racquet either previously or presently offered by the Assignee hereof to the public.

TABLE I

| Tear Drop Shape Frame | Total Area | Percentage of Largest Possible Area |
|---|---|---|
| Frame Outside Wall Area (Bedlam frame, substantially similar to FIGS. 1 and 2) | 115.06 sq. in. | 100% |
| Double Tube frame Design | 111.79 sq. in. | 97% |
| Bedlam Stun | 104.91 sq. in. | 91% |
| Bedlam 195 | 101.54 sq. in. | 88% |

All racquets in the above table are made of similar composite materials and all have a tear drop shape. The frame outside wall area (the area including the frame periphery) of each is substantially identical to the others, and is 115.06 sq. in. For this frame size, this is the theoretical maximum area which could be attained by an unimpeded or unconstrained string surface area. A design objective it to most closely approach this theoretical maximum. The measurements in the table were made of computer assisted design (CAD) drawings which were used to produce the frame molds, and using Autocad software.

In the Bedlam 195, 88% of the available surface area was occupied by strings which deflect unimpeded by any support structure. In the Bedlam Stun, the unimpeded string surface area increased to 91% of the total. The two-tube, remote-bridge morphology of the present invention enhances this percentage to 97% of the total.

Manufacture

Figure 16:
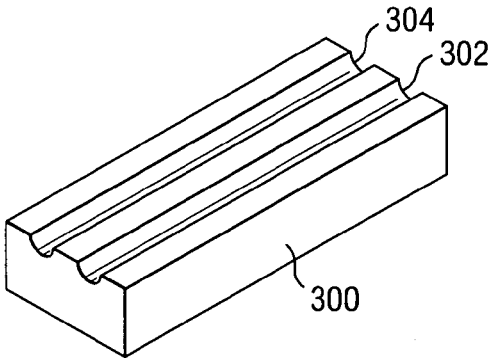
FIG. 16 is an isometric view of a spacing mold used in assembling a layup according to the invention.
Figure 18:
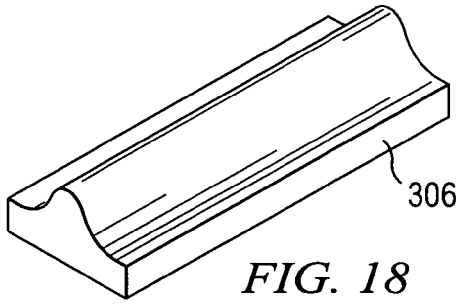
FIG. 18 is an isometric view of an alternative spacing mold used in assembling a layup according to the invention.
Figure 19A:
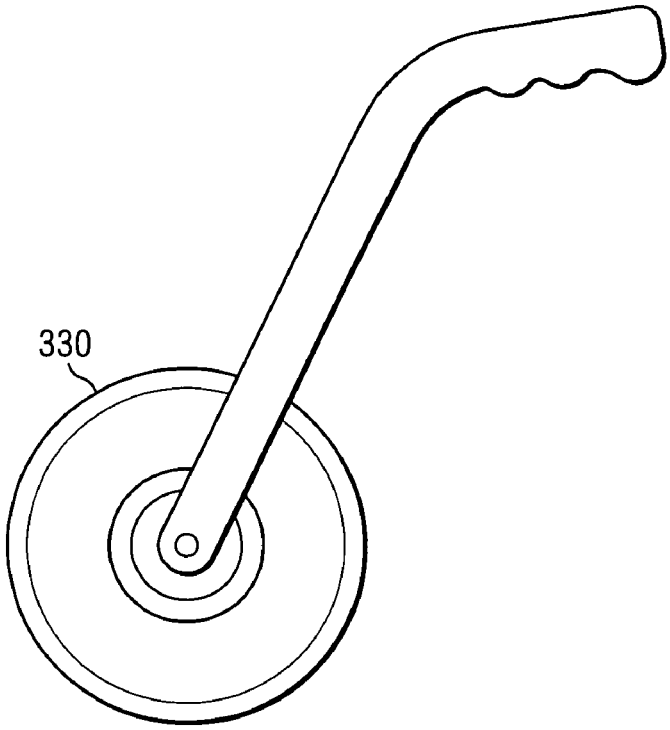
FIGS. 19A and 19B are elevational and end views of a first rolling/press tool used in forming a layup according to the invention.
Figure 19B:
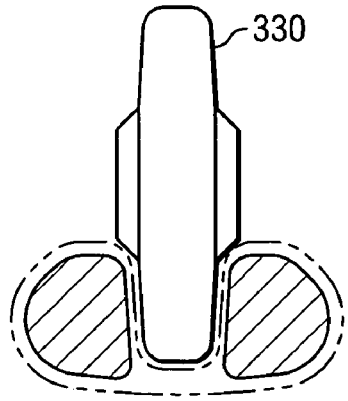
Figure 20A:
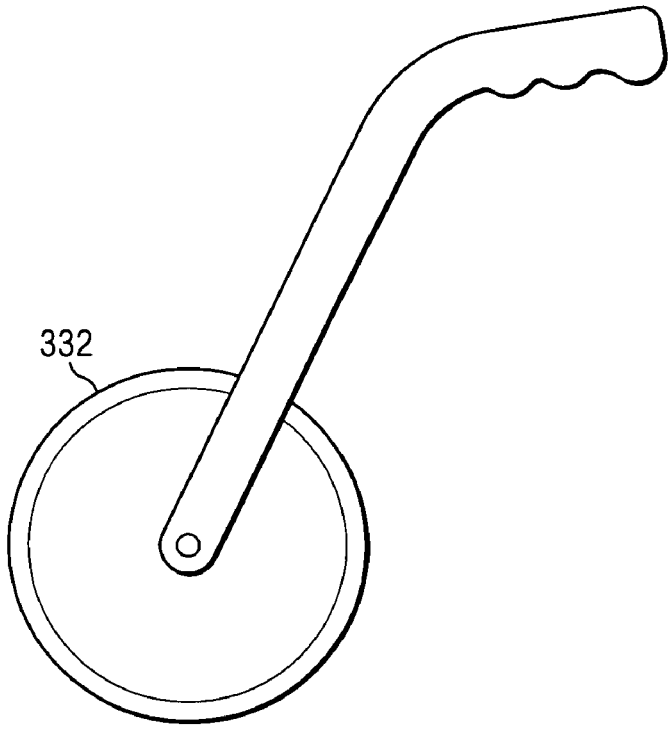
FIGS. 20A and 20B are elevational and end views of a second rolling/press tool used in forming a layup according to the invention.
Figure 20B:
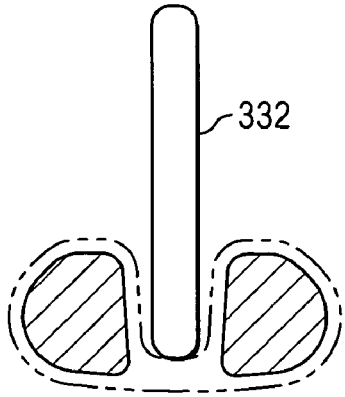

In manufacturing a composite racquet according to the invention, two individual tubes are rolled using multiple plies of pre-impregnated fibrous material around individual bladders and mandrels. A ply of fibrous material that will encapsulate both tubes 112 and tube 114 is placed on a jig or spacing mold. Such a jig or spacing mold is shown at 300 in FIG. 16. An alternative spacing mold is shown at 306 in FIG. 18.

Figure 17A:
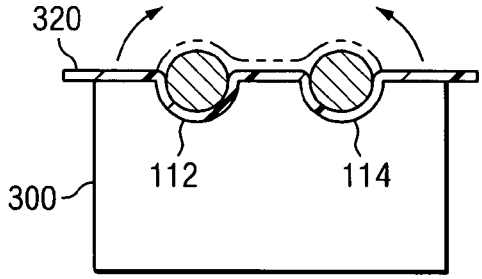
FIGS. 17A and 17B are sectional diagrams showing use of the spacing molds orjigs illustrated in FIGS. 16 and 18.
Figure 17B:
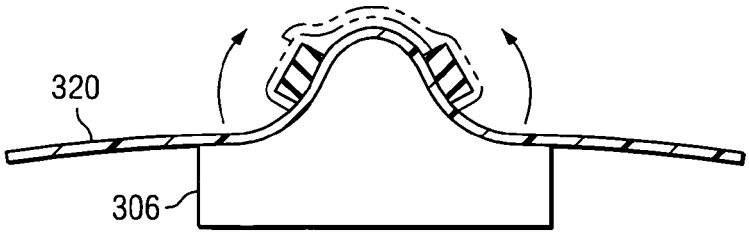

As using spacing mold 300, and referring to FIG. 17A, a first encapsulating ply 320 is placed to lay in both parallel grooves 302 and 304 and the space in between them. The individual tube layups are then placed in grooves 302 and 304. After this, other encapsulating plies are added to either the top or the bottom of the layup construction. Use of mandrel design 306 is shown in FIG. 17B.

After the addition of one or more encapsulating plies, a special roller tool is used to make sure that there are no voids in that part of the structure which will become part of the bridge, and to compress this part of the layup. Two varieties of such a roller are shown at 330 and 332 in FIGS. 19A, 19B, 20A and 20B.

Figure 21:
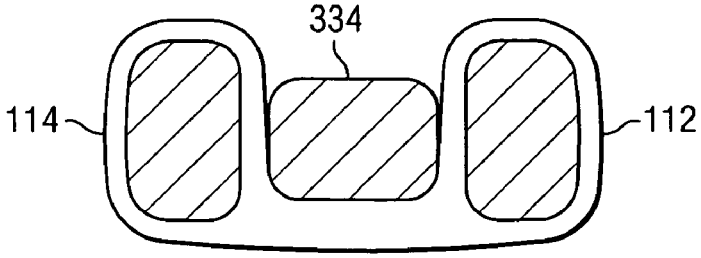
FIG. 21 is a cross-sectional view showing use of layup mandrels during fabrication of a racquet frame according to the invention.

After the layup is completed, a further, external mandrel 334 is added to the structure, as shown in FIG. 21. The external mandrel 334 is constructed of teflon for its rigidity, its high releasing properties, its high resistance to cleaning solvents and its ability to be machined. This material has not normally been selected in the past for use as a composite mandrel.

Once the layup is completed it is placed into a mold having a special design. In prior art composite racquet manufacturing processes, pressure is applied to the impregnated laminations through use of the internal bladders only. Since bridge 116 has no natural internally pressurizing structure, it must obtain curing pressure from somewhere else. According to one embodiment, this pressure is obtained from the bladders within tubes 112 and 114, and also from mold plates on opposed sides of the bridge 116 during cure. The use of external pressure in this way is, to the inventor's knowledge, unique in composite racquet manufacture.

Figure 22:
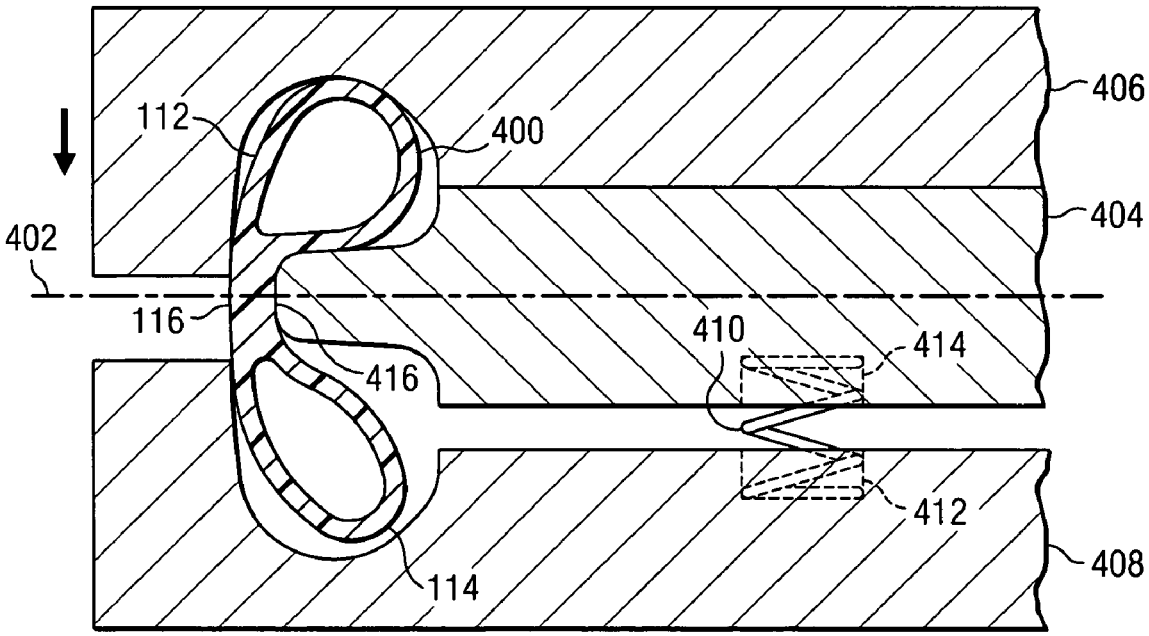
FIG. 22 is a cross sectional view showing use of specialized mold inserts in fabricating the invention.

In this two-tube manufacturing process, it is important to keep the frame layup in the same plane as the center plane of the frame mold. This is obtained by the apparatus illustrated in FIG. 22. The frame layup 400, here shown in sectional view and including the structures which will form upper tube 112, lower tube 114 and bridge 116, is arranged to be around a plane centerline 402, substantially corresponding to later string bed plane P. Central mold inserts 404 (a representative one is shown; there are multiple insert sections to permit insertion prior to cure and removal afterward) are likewise installed on this centerline 402. The mold is completed by an upper mold 406 and a lower mold 408.

To maintain this relationship, the applicants use one or more springs 410 (one shown), the bottom of which reside in respective lower mold receptacles 412, and the top of which are received in respective insert receptacles 414. Alternatively, a foam can be used. Springs 410 maintain the relationship of the inserts 404 to the layup 400 prior to closing the mold, such that a nose 416 of the insert 404 is in registry with the inner surface of bridge 116. When the mold is closed, the upper mold 406 compresses the inserts 404 and springs 410 until inserts 404 adjoin the upper surface of lower mold 408. Failure to do this can result in the nose 416 pinching lower tube 114, causing structural and molding problems. The molding technique of the present invention ensures that tubes 112 and 114 do not shift or twist inside the frame mold during the curing process.

After the mold is closed it is important to supply air to the two bladders simultaneously and at the same pressure. Failure to do this may result in having one tube be larger or in a different position than the other tube.

EXAMPLES

To demonstrate the technical advantages of the structure of the present invention over prior art and other structures, a series of tests was performed on a racquet according to the invention and having the morphology shown in FIGS. 1–4, and also on other racquet structures. FIGS. 8, 9 and 10A–10D are representative cross-sectional views of these other tested structures.

Figure 8:
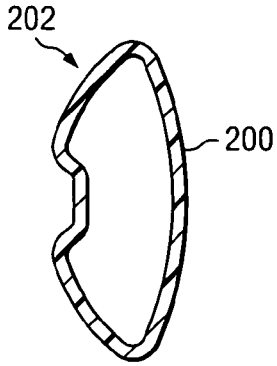
FIG. 8 (PRIOR ART)
FIG. 8 is a cross-sectional view of a composite racquet according to the prior art, showing a typical oval form.

FIG. 8 is a cross-sectional view of a prior art composite racquetball racquet frame. This cross section is basically an oval 200 with an indentation on one side. "Traditional oval" racquet 202 was constructed of composite materials similar to those used in the present invention and substantially the same as those in the sample according to the invention that was tested herein.

Figure 9:
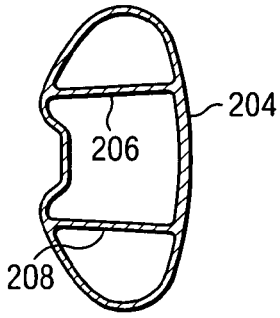
FIG. 9 (PRIOR ART)
FIG. 9 is a cross-sectional view of a prior art racquet frame made of aluminum alloy, showing oval form and internal walls.

FIG. 9 is a cross-sectional view of a prior art aluminum racquetball racquet frame 204. "Aluminum traditional oval" frame 204 has a pair of internal supports 206, 208 for purposes of stiffening. The control of the placement of these internal supports 206, 208 is not an issue in an aluminum or other metal structure, as the shape is simply extruded. Attempting to control the position of such internal walls or supports in a composite structure is an entirely different matter, however. As built in a composite, walls 206, 208 would be positioned by means of multiple bladders and/or the use of a relatively light but solid mandrel, such as balsa. In actual practice, the quality control problems associated with such structures have been severe, as there has been substantial variation in the positioning of such internal walls as a function of displacement along the frame length. For example, any variation in pressure during bladder inflation from one bladder to the other has had a tendency to cause one lumen to become convex while the other lumen becomes concave.

Figure 10A:
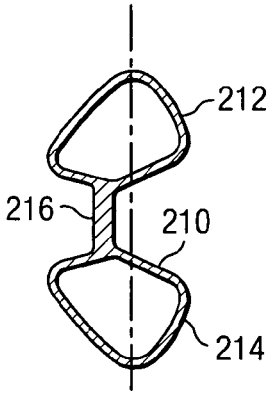
FIGS. 10A, 10B, 10C and 10D are cross-sectional views of various aluminum alloy "I-beam" racquet frames.
Figure 10B:
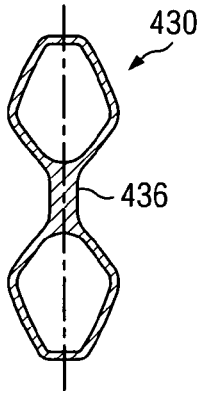
FIG. 10B (PRIOR ART)
Figure 10C:
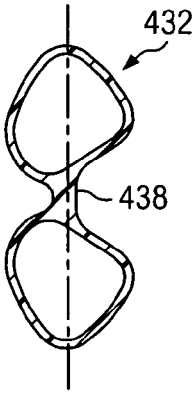
FIG. 10C (PRIOR ART)
Figure 10D:
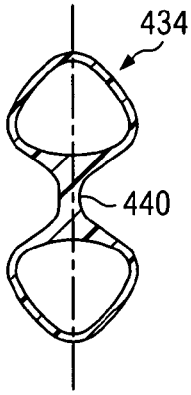
FIG. 10D (PRIOR ART)

FIG. 10A is a cross-sectional view of an aluminum racquetball prototype frame 210 built by the applicant. Somewhat erroneously called the "I-Beam" design, despite the presence of upper and lower tubes 212, 214, and including a connecting bridge 216, it was selected for comparative testing because of its similarity in overall shape to the tested structure made according to the invention. FIGS. 10B–10D are prior art aluminum "I-Beams" each having upper and lower tubes and a bridge in between them. FIG. 10B shows the cross section of an EKTELON ASCENT Ti frame 430. FIG. 10C shows a WILSON X-PRESS aluminum racquet frame. FIG. 10D shows a PRO-KENNEX POWER INNOVATOR aluminum racquet frame. In each of the prior art designs shown in FIGS. 10B–10D, the respective bridge 436, 438, 440 is positioned so that a portion of it intersects the center line drawn through the centers of the associated upper and lower tubes.

Four Point Flex Test

In this test, two round metal rods, 0.75 inches in diameter, are spaced twelve inches apart and fixed to a universal test machine base. The universal test machine used by applicants herein was Model QC 505 P made by Dachang Instruments of Taiwan. The tested racquet was placed on top of the two rods. A third rod, capable of applying loads to the upper portion of the racquet frame and centered at six inches between the two lower rods, is lowered to flex the racquet frame at each designated point across the racquet's frame. A load of fifty pounds was applied to each of four predetermined points, and the amount of flex measured.

TABLE II

| | Four Point Flex Test Data | | | | | |
|---|---|---|---|---|---|---|
| | Distance measured down the center line starting from the top of frame toward racquet | | | | Frame | |
| Model | 3.5" | 6" | 9" | 13" | Weight (grams) | Balance (mm) |
| Invention | .0145" | .009" | .008" | .010" | 155 | 276 |
| Traditional Oval (FIG. 8) | .016" | .010" | .009" | .009" | 154 | 276 |
| Aluminum Traditional Oval (FIG. 9) | .020" | .012" | .011" | .013" | 177 | 240 |
| Aluminum "I-Beams" | | | | | | |
| Frame 210 (FIG. 10A) | .018" | .011" | .015" | .020" | 171 | 257 |
| Frame 430 (FIG. 10B) | .019" | .015" | .013" | .011" | 211 | 249 |
| Frame 432 (FIG. 10C) | .020" | .018" | .012" | .011" | 201 | 250 |
| Frame 434 (FIG. 10D) | .018" | .013" | .010" | .011" | 176 | 252 |

The results show a modest improvement in stiffness of the "dual cylinder" composite form according to the invention compared with the prior art traditional oval made out of composite. There is a marked improvement in stiffness as compared with any of the tested aluminum structures, which are also heavier than the "dual cylinder" composite frame.

RA Flex Test

This test was performed on the samples above to determine relative flexibility by another method. In this test, a deflection is measured which results from an applied bending moment. The manufacturer of the RA Test apparatus used herein is Babolat VS. The tested sample frame (less handle) was positioned in the RA test fixture. A transverse load was applied to the upper head of the racquet, effecting a bending moment along the length of the frame. The deflection of the upper head is read from the apparatus's deflection gauge. The shaft support stirrup was located 21.6 cm from the end of the RA Test platform. The horizontal bar in the stirrup assembly is lowered to 2.5 cm below the top of the stirrup assembly. A 1661 gram weight was applied to the load lever. The results are shown in Table III.

TABLE III

RA Flex Test Data

| Model | Deflection Result (inches) | Frame Weight (grams) | Frame Balance (mm) | Frame Length (mm) |
|---|---|---|---|---|
| Invention | 0.335 | 155 | 276 | 556 |
| Traditional Oval (FIG. 8) | 0.346 | 154 | 276 | 556 |
| Aluminum Traditional Oval (FIG. 9) | 0.630 | 177 | 240 | 556 |
| Aluminum "I-Beams" | | | | |
| Frame 210 (FIG. 10A) | 0.555 | 171 | 257 | 556 |
| Frame 430 (FIG. 10B) | 0.594 | 211 | 249 | 556 |
| Frame 432 (FIG. 10C) | 0.610 | 201 | 250 | 556 |
| Frame 434 (FIG. 10D) | 0.740 | 176 | 252 | 556 |

While according to this test the rigidity of the "dual cylinder" frame according to the invention is slightly better than that of a traditional composite oval cross sectional frame, it is approximately 50% more rigid as compared with aluminum frames that are 20% heavier. The test demonstrates viability of the design in terms of stiffness in comparison with the traditional composite oval, while exhibiting superior characteristics in other respects as is described elsewhere herein.

Top Loading Test

Figure 11:
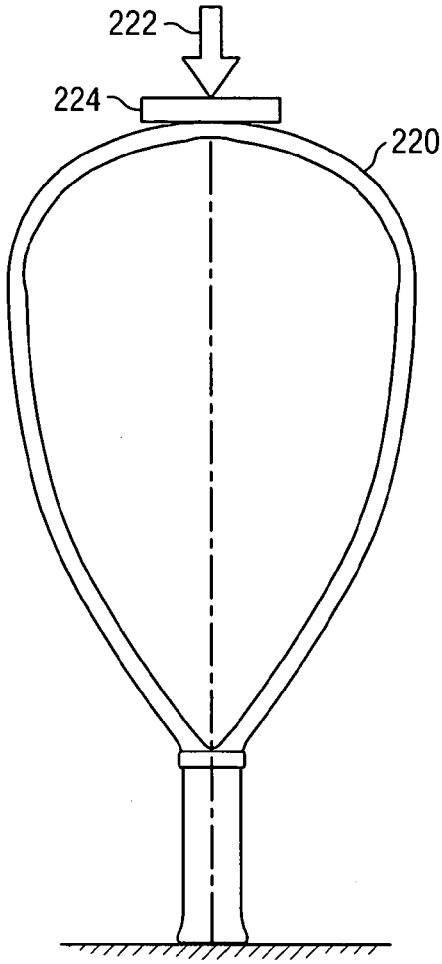
FIG. 11 is an elevational view showing positioning of a racquet for a top loading test.

Referring to FIG. 11, in this test the tested frame 220 is placed to stand vertically in a universal test machine. A compressive load 222 is applied until a half-inch stop is met (that is, until the frame has deflected 0.5 in.) The load at this point is recorded. The compressive loading is applied such that the speed of the 73 mm diameter crosshead 224 is about 3 cm per minute. Results for the different sample frames are tabulated in Table IV.

TABLE IV

Top Loading Test Data

| Model | Load in lbs. | Flex in Inches | Load/ Deflection (Lbs/0.1") | Frame Specifications Weight (grams) | Frame Specifications Balance (mm) |
|---|---|---|---|---|---|
| Invention | 305.4 | 0.5" | 30.5/0.1" | 155 | 276 |
| Traditional Composite Oval (FIG. 8) | 254.1 | 0.5" | 25.4/0.1" | 154 | 276 |
| Aluminum Traditional Oval (FIG. 9) | 154.1 | 0.5" | 15.4/0.1" | 177 | 240 |
| Aluminum "I-Beams" | | | | | |
| Frame 210 (FIG. 10A) | 124 | 0.5" | 12.4/0.1" | 171 | 257 |
| Frame 430 (FIG. 10B) | 84 | 0.5" | 8.4/0.1" | 211 | 249 |
| Frame 432 (FIG. 10C) | 125.3 | 0.5" | 12.5/0.1" | 201 | 250 |
| Frame 434 (FIG. 10D) | 100.7 | 0.5" | 10.1/0.1" | 176 | 252 |

The results show that a higher load was required to deflect the "dual cylinder" frame according to the invention than a "traditional oval" composite frame. The frame according to the invention was far stiffer than any of the aluminum structures, even with 20% less weight.

Top Loading Test on Frame Sections

Figure 12:
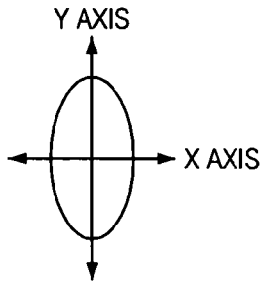
FIG. 12 is a diagram showing axes and direction of applied forces for the tests compiled in Tables V and VIII.

In this test, two composite (graphite) and two aluminum frame sections were cut, one from a racquet made according to the invention, and one each from structures shown in FIGS. 8–10D. The sections were of equal length. The tested sections were placed in alignment with the X-axis (as shown in FIG. 12), and a load applied along the X axis. When the section failed, results were recorded, and they appear in Table V below.

TABLE V

Cross-Section Top Loading Test Data

| Model | Load in lbs. | Frame Flex in Inches | Frame Weight (grams) |
|---|---|---|---|
| Invention | 544 | .083" | 4 g |
| Composite Traditional Oval (FIG. 8) | 241 | .076" | 4 g |
| Aluminum traditional Oval (FIG. 9) | 360 | .065" | 7.5 g |
| Aluminum "I-Beam" (FIG. 10A) | 385 | .072" | 7.2 g |

These results show that the structure of the present invention has superior strength characteristics when a load is applied in the direction of the x-axis. In particular, the sample according to the invention is 95% stronger along the x-axis than the traditional oval composite section, and 70% stronger than the tested aluminum structures. The present invention nonetheless has half the weight of the tested aluminum structures.

Angle Iron Side Loading Test

Figure 13:
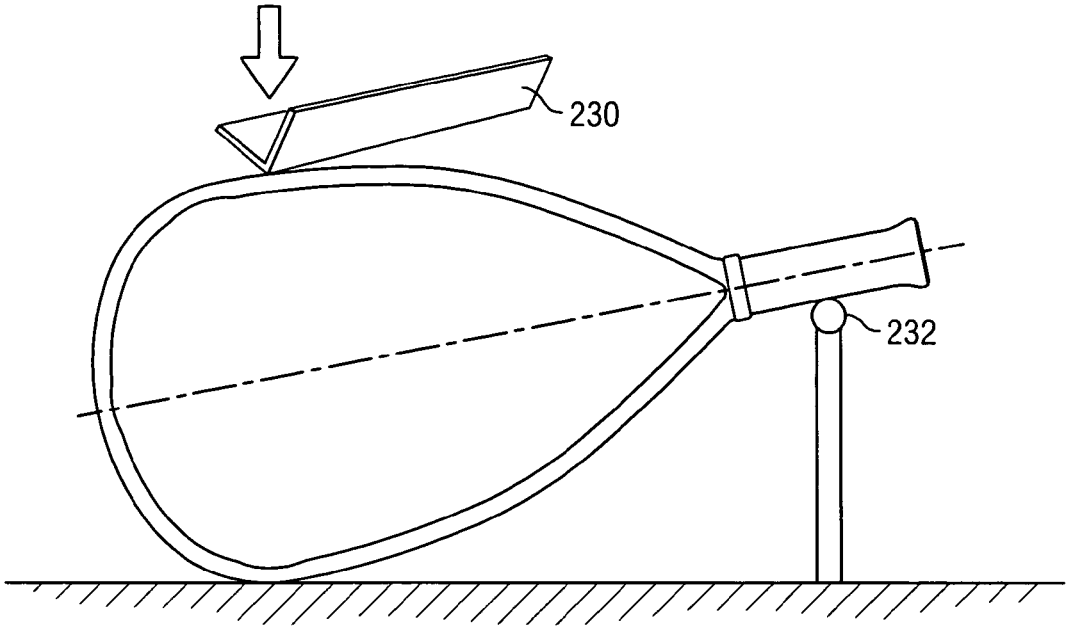
FIG. 13 is an elevational view showing the positioning of a racquet in an angle iron side loading test.

A pair of side loading tests was conducted on the composite samples depicted in FIGS. 1–4 and FIG. 8. This test applied a lateral compressive load to an unstrung racquet frame in order to ascertain static lateral hoop strength. The racquet frame is placed sidewise in a test machine as shown in FIG. 13. Compressive loading is applied at a crosshead speed of approximately 3 cm/min. The crosshead used is an angle iron 230, and two series of tests were run: one with a corner of the angle iron placed in parallel to the length of the racquet frame (the "longitudinal" test), and one in which the corner edge of the angle iron is rotated to be perpendicular to the length of the frame in order to create a point or "knife edge" load. In the test, the distance from a rest 232 to the angle iron crosshead 230 was 342.36 mm, while the height of the rest was 202.9 mm. The frames were tested to failure. Results are shown in Table VI.

TABLE VI

Side Loading Test: Angle iron per test standard vs. Modified test with angle iron rotated 90 degrees

| Model | Load in lbs. | Flex in Inches | Frame Weight (grams) |
|---|---|---|---|
| Double Tube Composite Longitudinal (Invention) | 318 | 1.095" | 155 g |
| Double Tube Composite Perpendicular (Invention) | 295.7 | 1.051" | 157 g |
| Oval Cross Section Composite Longitudinal (FIG. 8) | 309 | .902" | 156 g |
| Oval Cross Section Composite Perpendicular (FIG. 8) | 128.9 | .048" | 155 g |

While the results of the "longitudinal" test for the prior art composite oval and the "dual cylinder" shape of the invention were comparable, the structure of the invention exhibited far superior strength in the perpendicular "knife edge" test. The present invention shows enhanced performance here because the load is displaced over a larger area.

Side Loading to Half-Inch Stop

This test tested a structure according to the invention and racquets having cross-sectional shapes and materials as described for FIGS. 8–10D. The test performed was similar to the longitudinal test described above, but deflection was stopped at 0.5" rather than permitted to proceed to failure. Results are given in Table VII below.

TABLE VII

Side Loading Test Data

| Model | Load in lbs. | Flex in Inches | Load/ Deflection (Lbs/0.1") | Frame Specifications Weight (grams) | Frame Specifications Balance (mm) |
|---|---|---|---|---|---|
| Double tube composite (Invention) | 156.5 | 0.5" | 15.6/0.1" | 155 | 276 |
| Traditional Oval Composite (FIG. 8) | 128 | 0.5" | 12.8/0.1" | 154 | 276 |
| Aluminum Traditional Oval (FIG. 9) | 80 | 0.5" | 8/0.1" | 177 | 240 |
| Aluminum "I-Beams" | | | | | |
| Frame 210 (FIG. 10A) | 76 | 0.5" | 7.6/0.1" | 171 | 257 |
| Frame 430 (FIG. 10B) | 53.3 | 0.5" | 5.3/0.1" | 211 | 249 |

TABLE VII-continued

Side Loading Test Data

| Model | Load in lbs. | Flex in Inches | Load/ Deflection (Lbs/0.1") | Frame Specifications Weight (grams) | Frame Specifications Balance (mm) |
|---|---|---|---|---|---|
| Frame 432 (FIG. 10C) | 68.6 | 0.5" | 6.9/0.1" | 201 | 250 |
| Frame 434 (FIG. 10D) | 54 | 0.5" | 5.4/0.1" | 176 | 252 |

These tests again demonstrate that a composite structure according to the invention resists a lateral load better than a prior art oval composite frame, and is significantly stiffer than any of the tested aluminum frames.

Side Loading Test of Sections

Racquet sections of equal length were cut, one for each of the shapes and materials shown in FIGS. 8–10A and one according to the invention. The sections were aligned along the X-axis as shown in FIG. 12 and a load applied along the Y-axis. Results are tabulated in Table VIII.

TABLE VIII

Cross-Section Side Loading Test Data

| Model | Load in lbs. | Flex in Inches | Section Weight (grams) |
|---|---|---|---|
| Double tube composite (Invention) | 100.25 | .01" | 3 g |
| Traditional Oval composite (Fig. 8) | 128 | .09" | 3 g |
| Aluminum Oval (FIG. 9) | 265 | .052" | 6.8 g |
| Aluminum "I-Beam" (FIG. 10A) | 280 | .063" | 7 g |

Surprisingly, the structure of the present invention was almost as rigid as compared with a traditional oval composite; it had been expected that the present invention would exhibit comparatively less rigidity on this test. The aluminum shapes were 2.7 times stronger than the present invention, however at a penalty of the twice the weight.

Slap Test

Figure 14:
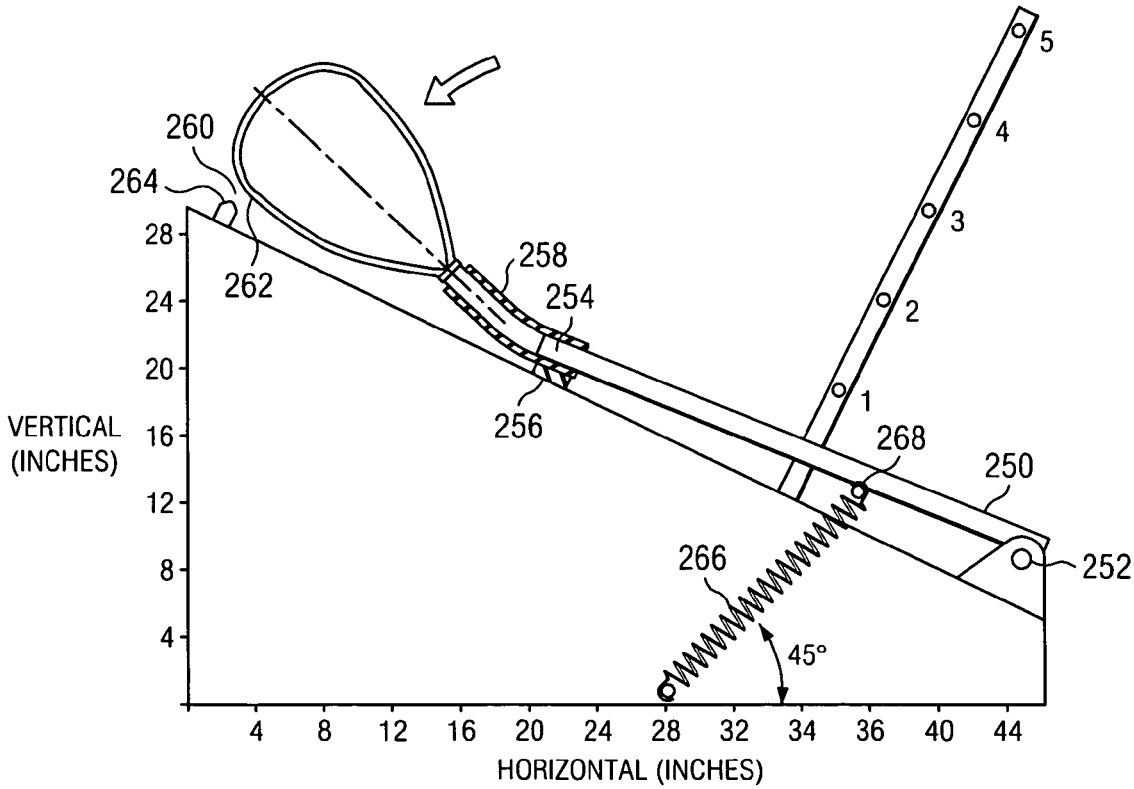
FIG. 14 is a diagram showing apparatus and measurements in a "slap" test performed to assess resistance of the tested racquet frames to frame impacts.

This test measures the resistance of a racquet frame to impact loads such as might be experienced in a racquet-to-racquet or racquet-to-wall contact, as might occur in racquetball or squash. An unstrung frame sample of the kinds indicated in Table IX was clamped into an apparatus diagrammed in FIG. 14. The apparatus has a 29 in. long steel tube, 1½ in.×2 in.×⅛ in. thick, hinged at 252 to a steel angle weldment framework. The free end 254 of the steel tube rests on a rubber pad 256. A rubber hose 258 is attached to the end of the steel tube, and the handle of the tested racquet frame is inserted into the hose until the butt end is adjacent the steel tube end. The length of the hose as measured from the end of the steel tube 254 is 5 cm. The thickness of the rubber pad 256 is adjusted such that a 2 cm–3 cm gap 260 appears between a steel impact point 262 and the frame edge 264. The distance between hinge 252 and steel impact point 262 is 119 cm. The steel tube is tensioned by a stiff helical spring 266 that makes a 45 degree angle with respect to the horizontal while at rest, and which is attached to the tube 250 at point 268. Spring 266 has a spring constant of about 9 kg/cm.

Figure 15:
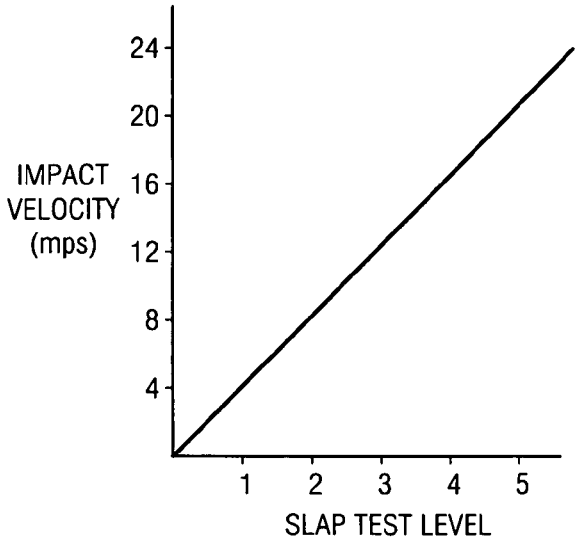
FIG. 15 is a graph of slap test level v. impact velocity.

In operation, the steel tube is pulled back to one of positions 1–5. A stop is pulled out, which releases tube 250 toward pad 256. FIG. 15 is a graph which shows the correlation between positions (slap test levels) 1–5 and impact velocities, while Table X correlates these test levels with impact forces. While the rubber pad 256 absorbs the impact of the steel tube, inertia propels the racquet frame onward until it hits the steel impact point 262. Table IX tabulates the results.

TABLE IX

| | Slap Test Data | | | | | Frame | |
|---|---|---|---|---|---|---|---|
| Model | Level 1 | Level 2 | Level 3 | Level 4 | Level 5 | Weight (grams) | Balance (mm) |
| Double tube composite (Invention) | ok | Ok | small crack at impact location | Fail | | 155 | 276 |
| Traditional Oval composite (FIG. 8) | ok | small crack at impact location | Fail | | | 154 | 276 |
| Aluminum Traditional Oval (FIG. 9) | small dent at impact | frame beginning to distort and dent at impact increased in size | racquet completely deformed and unplayable | | | 177 | 240 |
| Aluminum "I-BeamS" | | | | | | | |
| Frame 210 (FIG. 10A) | | | | | | 171 | 257 |
| Frame 430 (FIG. 10B) | | | | | | 211 | 249 |
| Frame 432 (FIG. 10C) | small dent at impact | frame beginning to distort and dent at impact increased in size | racquet completely deformed and unplayable | | | 201 | 250 |
| Frame 434 (FIG. 10D) | small dent at impact | frame beginning to distort and dent at impact increased in size | racquet completely deformed and unplayable | | | 176 | 252 |

TABLE X

| Impact force at indicated levels | |
|---|---|
| Level 1 | 125.08 lbs |
| Level 2 | 222.51 lbs |
| Level 3 | 339.44 lbs |
| Level 4 | 432.74 lbs |
| Level 5 | 518 lbs |

From these data, we conclude that the racquet according to the invention is able to withstand a level 3 impact with minimal surface damage, while a traditional oval composite frame fails completely. The present invention exhibits far superior impact results in comparison with the significantly heavier aluminum frames.

In summary, a novel double-tube composite sports racquet frame structure has been shown and described. The structure enhances the unimpeded string length of the racquet's long strings and cross strings, and has been found to be structurally stronger in many respects than prior art composite racquet frames having simple oval cross sections or any of various aluminum shapes.

While preferred embodiments of the present invention have been described in the above detailed description and illustrated in the appended drawings, the present invention is not limited thereto but only by the scope and spirit of the claims which follow.

I claim:

1. A sports racquet, comprising:

a frame having a head portion across which a plurality of string segments are strung, the head portion surrounding a string bed defining a string bed plane and having a center;

the head portion having at least a first section comprising, in cross section, an upper tube disposed above the string bed plane and a lower tube disposed below the string bed plane, a bridge joining the upper tube to the lower tube, the bridge intersecting the string bed and supporting the string segments, the section of the upper tube and the lower tube defining a center line disposed at an angle to the string bed;

the bridge disposed substantially outwardly from the center line so as to be remote from the center, no structure of the first section of the head portion being disposed inwardly from the center line and intersecting the string bed plane.

2. The racquet of claim 1, wherein the head portion is integrally formed of a composite material including multiple laminations of sheets of fibrous material, as impregnated with a polymer.

3. The racquet of claim 1, wherein the center line of the cross section of the first section of the head portion is substantially perpendicular to the plane of the string bed.

4. The racquet of claim 1, wherein holes are formed through the bridge to receive the string segments.

5. The racquet of claim 1, wherein the racquet is selected from the group consisting of tennis rackets, racquetball racquets, squash racquets and badminton racquets.

6. The racquet of claim 1, wherein the head portion is disposed around a periphery of the string bed, a cross section of at least one of the upper and lower tubes of the first section of the head portion at one point on the periphery being different than a cross section of said at least one of the upper and lower tubes taken at a second point spaced from the first point along the periphery.

7. The racquet of claim 1, wherein the bridge has an external surface remote from the center of the string bed plane, a string grommet groove formed in said external surface for receiving a string grommet.

8. The sports racquet of claim 1, wherein the frame is formed of a composite of plural laminations of fibrous material impregnated with a polymer, the head portion of the frame being elongate, the upper tube of the first section of the head portion being elongate in the direction of elongation of the head portion, the lower tube of the first section of the head portion being elongate in the direction of elongation of the head portion and disposed generally in parallel to the upper tube, the bridge being elongate in the direction of elongation of the head portion, the bridge having no cavity which is elongate in said direction of elongation of the head portion.

9. The racquet of claim 1, wherein the bridge is substantially perpendicular to the string bed plane.

10. The racquet of claim 1, wherein the head portion further includes a second section having only one tube, the second section joined to the first section end to end, the second section being integrally formed with the first section.

11. The sports racquet of claim 1, wherein the head portion is comprised of an endless wall of composite material, the composite material formed of a plurality of laminations of fibrous material as impregnated with a polymer, the endless wall having an outer portion relatively remote from the center of the string bed and an inner portion relatively near to the center of the string bed; and the endless wall forms the upper tube, the lower tube and the bridge, the bridge spacing the upper tube from the lower tube in a depth direction orthogonal to the string bed plane, the outer portion of the endless wall being joined to the inner portion of the endless wall along the depth direction of the bridge.

12. The sports racquet of claim 11, wherein at least one of said plurality of laminations of fibrous material has a fiber orientation that is neither parallel to a direction of elongation of the frame head portion nor perpendicular thereto, said at least one lamination being present in said outer portion of the endless wall and the inner portion of the endless portion, such that fibers in said at least one lamination in the outer portion will be disposed at an angle to fibers in said at least one lamination in the inner portion.

13. The sports racquet of claim 12, wherein the angle is selected from the group consisting of ten degrees, 22 degrees, 45 degrees and 60 degrees.

14. The sports racquet of claim 11, wherein the fibers comprise carbon.

15. The sports racquet of claim 1, wherein the head portion defines and surrounds a strung area, the frame formed of a composite including plural laminations of fibrous material as impregnated with a polymer, a periphery of the head portion defining a theoretical maximum area across which unconstrained strings can be strung, an actual area across which unconstrained strings are strung being more than 91% of said theoretical maximum area.

* * * * *